US009346158B2

(12) United States Patent
Garber et al.

(10) Patent No.: US 9,346,158 B2
(45) Date of Patent: May 24, 2016

(54) MAGNETIC PROFILE LIFTER

(71) Applicant: BLACK & DECKER INC., Newark, DE (US)

(72) Inventors: Stuart E. Garber, Towson, MD (US); Paul G. Gross, White Marsh, MD (US); Lee Michael Brendel, Bel Air, MD (US)

(73) Assignee: BLACK & DECKER INC., New Britain, CT (US)

( * ) Notice: Subject to any disclaimer, the term of this patent is extended or adjusted under 35 U.S.C. 154(b) by 556 days.

(21) Appl. No.: 13/798,576

(22) Filed: Mar. 13, 2013

(65) Prior Publication Data

US 2014/0076952 A1 Mar. 20, 2014

Related U.S. Application Data

(60) Provisional application No. 61/703,473, filed on Sep. 20, 2012.

(51) Int. Cl.
*B25C 1/06* (2006.01)

(52) U.S. Cl.
CPC ..... *B25C 1/06* (2013.01)

(58) Field of Classification Search
CPC ..... B25C 1/06; B25C 1/04; B25C 1/047; B27F 7/09; B27F 7/11
USPC ..... 227/129, 130, 113, 131
See application file for complete search history.

(56) References Cited

U.S. PATENT DOCUMENTS

| | | | |
|---|---|---|---|
| 1,945,892 | A | 2/1934 | Gobin |
| 2,069,042 | A | 1/1937 | Marchant |
| 2,593,715 | A | 4/1952 | Adler |
| 2,852,424 | A | 9/1958 | Reinhart |
| 3,305,156 | A | 2/1967 | Khan |
| 3,378,426 | A | 4/1968 | Medney |
| 3,500,940 | A | 3/1970 | Guest |
| 3,768,577 | A | 10/1973 | Leoni |
| 3,854,537 | A | 12/1974 | Nelmark et al. |
| 3,891,036 | A | 6/1975 | Schmidt |
| 3,930,297 | A | 1/1976 | Potucek et al. |
| 3,937,286 | A | 2/1976 | Wagner |
| 4,042,036 | A | 8/1977 | Smith et al. |
| 4,121,745 | A | 10/1978 | Smith et al. |
| 4,129,240 | A | 12/1978 | Geist |
| 4,189,080 | A | 2/1980 | Smith et al. |

(Continued)

FOREIGN PATENT DOCUMENTS

| | | | |
|---|---|---|---|
| EP | 2135710 | A1 | 12/2009 |
| EP | 2230050 | A1 | 9/2010 |

OTHER PUBLICATIONS

Dewaele, Karl—European Search Report re corresponding European Patent Application No. 13185325—Apr. 8, 2015—8 pages—The Hague.

*Primary Examiner* — Hemant M Desai
*Assistant Examiner* — Valentin Neacsu
(74) *Attorney, Agent, or Firm* — Harness, Dickey & Pierce, P.L.C.

(57) ABSTRACT

A flywheel-driven tool includes a ferromagnetic driver. The driver has a firing position in which the driver is drivingly engaged against the flywheel. The driver also has a home position radially further away from the flywheel than the firing position when the flywheel is spinning in preparation to firing the driver. A magnet is positioned adjacent the driver to exert a magnetic force on the driver to pull the driver into the home position.

18 Claims, 7 Drawing Sheets

(56) References Cited

U.S. PATENT DOCUMENTS

| | | | | |
|---|---|---|---|---|
| 4,204,622 | A | 5/1980 | Smith et al. | |
| 4,323,127 | A | 4/1982 | Cunningham | |
| 4,434,121 | A | 2/1984 | Schäper | |
| 4,473,217 | A | 9/1984 | Hashimoto | |
| 4,519,535 | A | 5/1985 | Crutcher | |
| 4,530,454 | A | 7/1985 | Gloor et al. | |
| 4,544,090 | A | 10/1985 | Warman et al. | |
| 4,558,747 | A | 12/1985 | Cunningham | |
| 4,721,170 | A | 1/1988 | Rees | |
| 4,724,992 | A | 2/1988 | Ohmori | |
| 4,756,602 | A | 7/1988 | Southwell et al. | |
| 4,773,633 | A | 9/1988 | Hinz et al. | |
| 4,928,868 | A | 5/1990 | Kerrigan | |
| 4,938,297 | A | 7/1990 | Schmidt et al. | |
| 4,964,558 | A | 10/1990 | Crutcher et al. | |
| 5,069,379 | A | 12/1991 | Kerrigan | |
| 5,088,566 | A | 2/1992 | Gustafsson et al. | |
| 5,098,004 | A * | 3/1992 | Kerrigan | B25C 5/15 173/121 |
| 5,343,962 | A | 9/1994 | Daigle et al. | |
| 5,445,227 | A | 8/1995 | Heppner | |
| 5,511,715 | A | 4/1996 | Crutcher et al. | |
| 5,802,691 | A | 9/1998 | Zoltaszek | |
| 5,975,217 | A | 11/1999 | Frenzel et al. | |
| 5,992,541 | A | 11/1999 | Frenzel et al. | |
| 6,000,477 | A | 12/1999 | Campling et al. | |
| 6,068,250 | A | 5/2000 | Hawkins et al. | |
| 6,315,059 | B1 | 11/2001 | Geldean | |
| 6,454,251 | B1 | 9/2002 | Fish | |
| 6,607,111 | B2 | 8/2003 | Garvis et al. | |
| 6,669,072 | B2 | 12/2003 | Burke et al. | |
| 7,204,403 | B2 | 4/2007 | Kenney et al. | |
| 7,503,401 | B2 | 3/2009 | Gross et al. | |
| 7,556,184 | B2 | 7/2009 | Brendel et al. | |
| 7,575,141 | B1 | 8/2009 | Liang et al. | |
| 7,575,142 | B2 | 8/2009 | Liang et al. | |
| 7,789,169 | B2 | 9/2010 | Berry et al. | |
| 8,142,365 | B2 | 3/2012 | Miller | |
| 8,302,833 | B2 | 11/2012 | Gross et al. | |
| 2002/0003045 | A1 | 1/2002 | Bongers-Ambrosius | |
| 2002/0108993 | A1 | 8/2002 | Harper et al. | |
| 2002/0108994 | A1 | 8/2002 | Burke et al. | |
| 2002/0108995 | A1 | 8/2002 | Hempfling et al. | |
| 2005/0217873 | A1 * | 10/2005 | Gross | B25C 1/06 173/1 |
| 2005/0218177 | A1 | 10/2005 | Berry et al. | |
| 2005/0218178 | A1 | 10/2005 | Berry et al. | |
| 2005/0218182 | A1 | 10/2005 | Berry et al. | |
| 2005/0218183 | A1 | 10/2005 | Berry et al. | |
| 2007/0095876 | A1 | 5/2007 | Oda et al. | |
| 2007/0102471 | A1 | 5/2007 | Gross et al. | |
| 2008/0048000 | A1 | 2/2008 | Simonelli et al. | |
| 2008/0302852 | A1 * | 12/2008 | Brendel | B25C 1/06 227/131 |
| 2009/0032567 | A1 * | 2/2009 | Liang | B25C 1/06 227/131 |
| 2009/0236387 | A1 | 9/2009 | Simonelli et al. | |
| 2010/0187280 | A1 | 7/2010 | Akiba et al. | |
| 2010/0258608 | A1 | 10/2010 | Porth et al. | |
| 2012/0097729 | A1 | 4/2012 | Gross et al. | |

* cited by examiner

MAGNETIC PROFILE LIFTER

CROSS-REFERENCE TO RELATED APPLICATIONS

This application claims the benefit of U.S. Provisional Application No. 61/703,473, filed on Sep. 20, 2012. The entire disclosure of the above application is incorporated herein by reference.

FIELD

The present disclosure relates in general to the field of flywheel driven fastening tools, and more particularly to such a fastening tool having a magnetic profile lifter.

BACKGROUND

This section provides background information related to the present disclosure which is not necessarily prior art.

Most cordless nailers that use a flywheel to deliver kinetic energy to propel the driver (or profile) include a lifter spring to hold the driver off of the flywheel when in the home position. This spring reduces wear and noise when the flywheel is spinning preparing to fire. However, the springs in use on existing production tools have two major flaws.

First, existing springs only control movement of the driver in the radial direction relative to the flywheel so the driver is still allowed to move side to side. This lack of restraint allows noise and minor wear if the driver contacts the flywheel in the home position.

Second, the spring is compressed and stretched every time the tool fires. Over time, this reduces the springs ability to maintain correct compliance and strength for the life of the tool. Broken or weakened springs do not adequately hold the driver away from the flywheel in the home position which can also result in wear and noise as the flywheel is spinning preparing to fire.

SUMMARY

This section provides a general summary of the disclosure, and is not a comprehensive disclosure of its full scope or all of its features.

In one aspect of the present disclosure a flywheel-driven fastener driving tool is provided including a frame. A motor is coupled to the frame and operably coupled to a flywheel to rotate the flywheel. A driver including a ferromagnetic material is movable along a driver axis relative to the frame between a returned position and an extended position. The driver has a firing position in which the driver is drivingly engaged against the flywheel. The driver also has a home position radially further away from the flywheel than the firing position when the driver is in the returned position and the flywheel is spinning in preparation to firing the driver toward the extended position. A magnet is coupled to the frame and positioned adjacent the driver to exert a magnetic force on the driver to pull the driver into the free position.

In another aspect of the present disclosure, a flywheel-driven fastener driving tool is provided including a frame. A motor is coupled to the frame and operably coupled to a flywheel to rotate the flywheel. A driver including a ferromagnetic material movable along a driver axis relative to the frame between a returned position and an extended position. The driver has a firing position in which the driver is pinched against the flywheel. The driver also has a driver home position radially further away from the flywheel than the firing position when the driver is in the returned position and the flywheel is spinning in preparation to firing the driver toward the extended position. A follower is coupled to the frame and has a follower engagement position corresponding to the firing position of the driver in which the driver is pinched between the follower and the flywheel. The follower also has a follower home position allowing the driver to move into the driver home position. A magnet is coupled to the frame and positioned adjacent the driver to exert a magnetic force on the driver to pull the driver into the free position.

In yet another aspect of the disclosure a method of operating a fastener driver tool is provided. The method includes providing a fastener driver tool that includes a frame and an electric motor coupled to the frame, a flywheel driven by the electric motor, a ferromagnetic driver magnetically held in a home position adjacent the flywheel while the flywheel is spinning in preparation to fire, an actuator to push the ferromagnetic driver radially toward the flywheel into driving engagement with the flywheel to fire the ferromagnetic driver; and a magnet exerting a magnetic force to pull the ferromagnetic driver radially away from the flywheel and into the home position after the ferromagnetic driver has been fired.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate identical or similar corresponding parts throughout the several views of the drawings.

DETAILED DESCRIPTION

Figure 1:
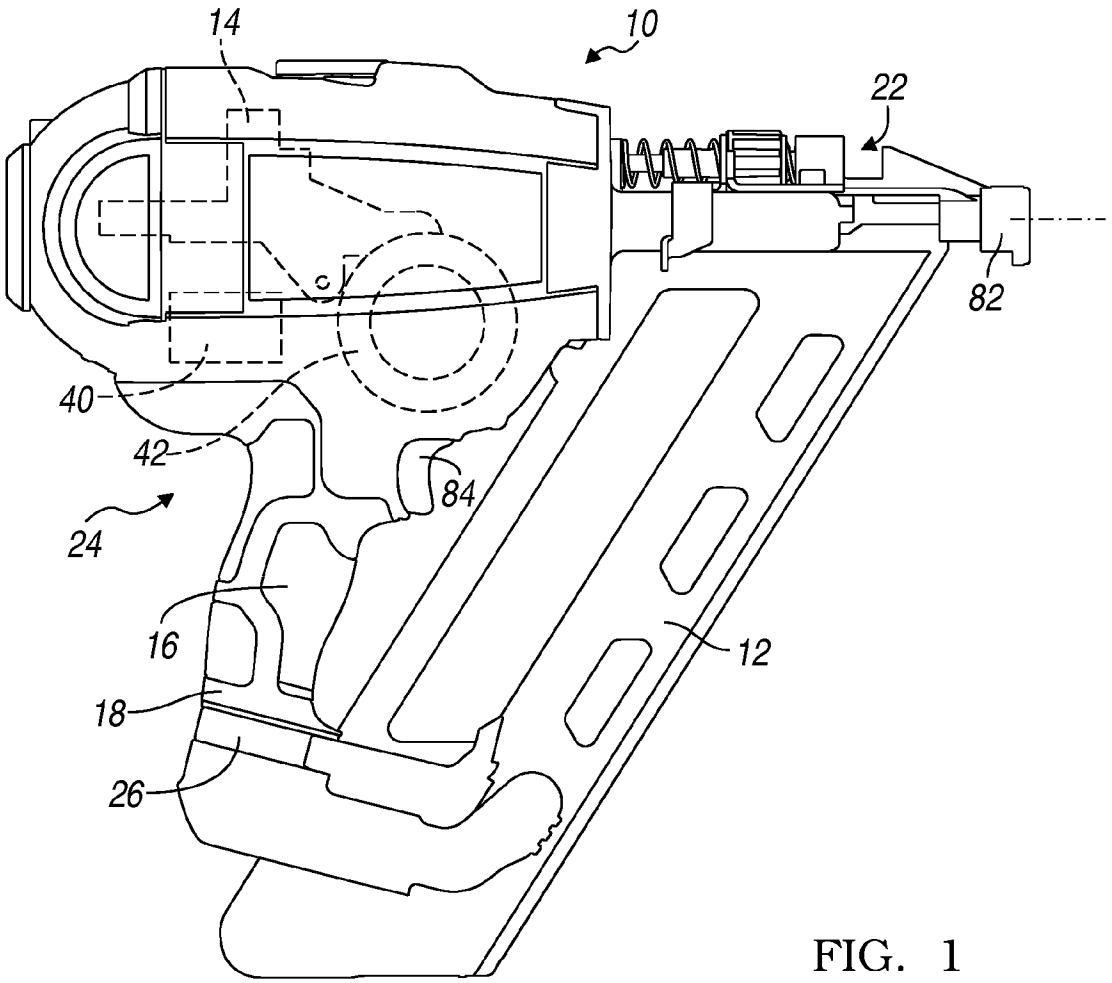
FIG. 1 is a side elevation view of a driving tool constructed in accordance with the teachings of the present disclosure.
Figure 2:
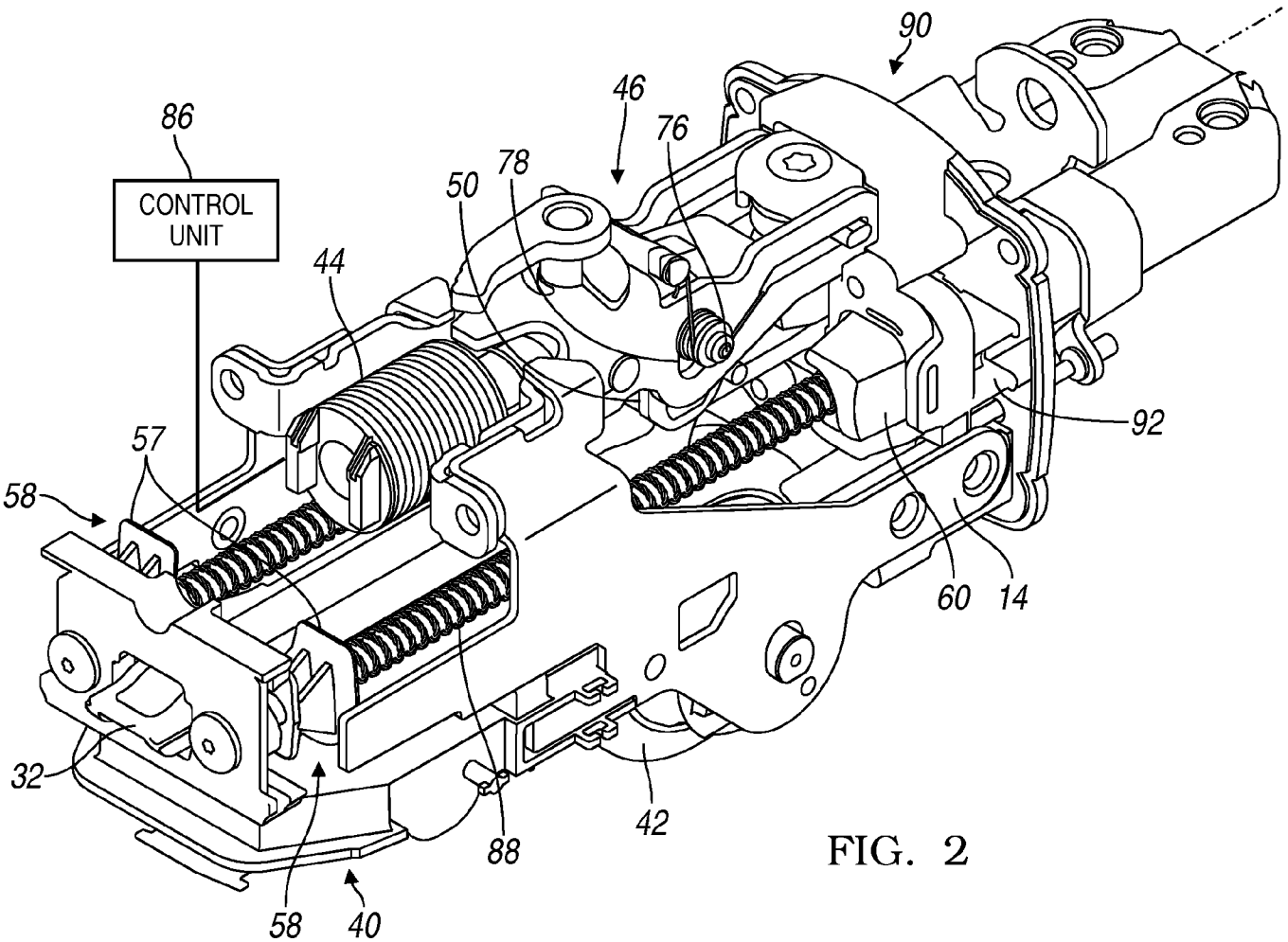
FIG. 2 is a perspective view of various internal components of the tool of FIG. 1.

Example embodiments will now be described more fully with reference to the accompanying drawings. While the fastening tool 10 is illustrated as being electrically powered by a suitable power source, such as the battery pack 26, those skilled in the art will appreciate that the invention, in its broader aspects, may be constructed somewhat differently and that aspects of the present invention may have applicability to pneumatically powered fastening tools. Furthermore, while aspects of the present invention are described herein and illustrated in the accompanying drawings in the context of a nailer, those of ordinary skill in the art will appreciate that the invention, in its broadest aspects, has further applicability.

With reference to FIGs. 1-4, a fastener driving tool 10 generally comprises a backbone or frame 14 supported within a housing 24. The housing 24 includes a magazine portion 12 for positioning fasteners F in line with a driver 32. The housing 24 also includes a handle portion 16, and a mount 18 for coupling a battery 26 to the housing 24.

Coupled to the backbone or frame 14 are a motor 40 and a flywheel 42. The motor 40 is operably coupled to the flywheel 42 to rotate the flywheel 42. For example, the motor 40 can be an outer rotor brushless motor where the flywheel 42 is an integral part of the outer rotor. Alternatively, motor 40 can be drivingly coupled to flywheel 42 via a transmission (not shown). Also coupled to the frame 14 are an actuator 44 and a follower assembly 46, including a pinch wheel or follower 50.

Figure 5:
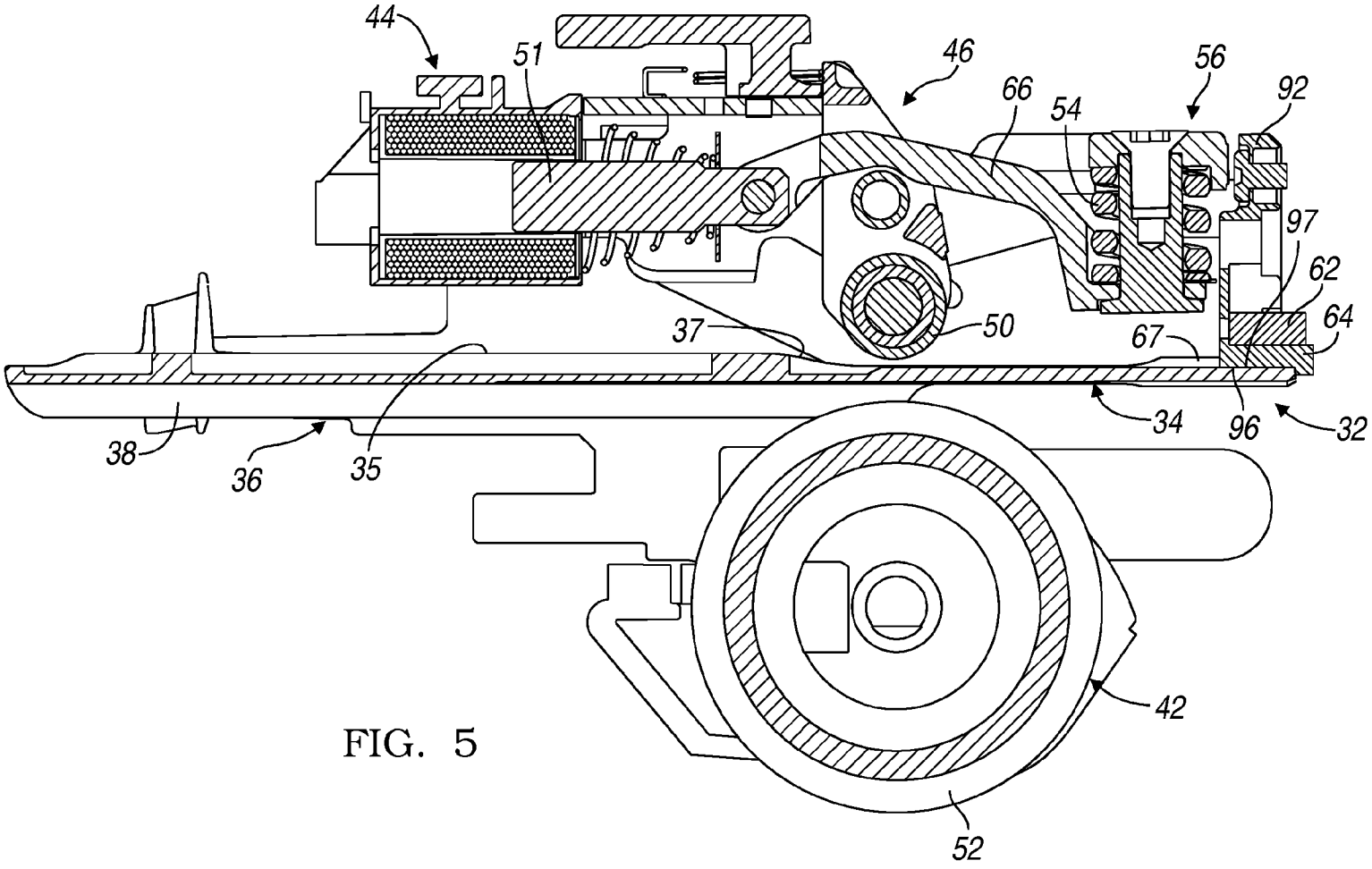
FIG. 5 is a cross-sectional view illustrating some of the components of FIG. 2 in their home positions.

The driver 32 is movable along a driver axis relative to the frame 14 from a returned position to an extended position to drive a fastener. The driver 32 is also movable in a radial direction relative to the flywheel 42 between an engaged or firing position (FIG. 6) and a home position (FIG. 5). In the firing position, the driver 32 is drivingly engaged against the flywheel 42. In the home position, the driver 32 is radially further away from the flywheel 42 than in the firing position.

Figure 6:
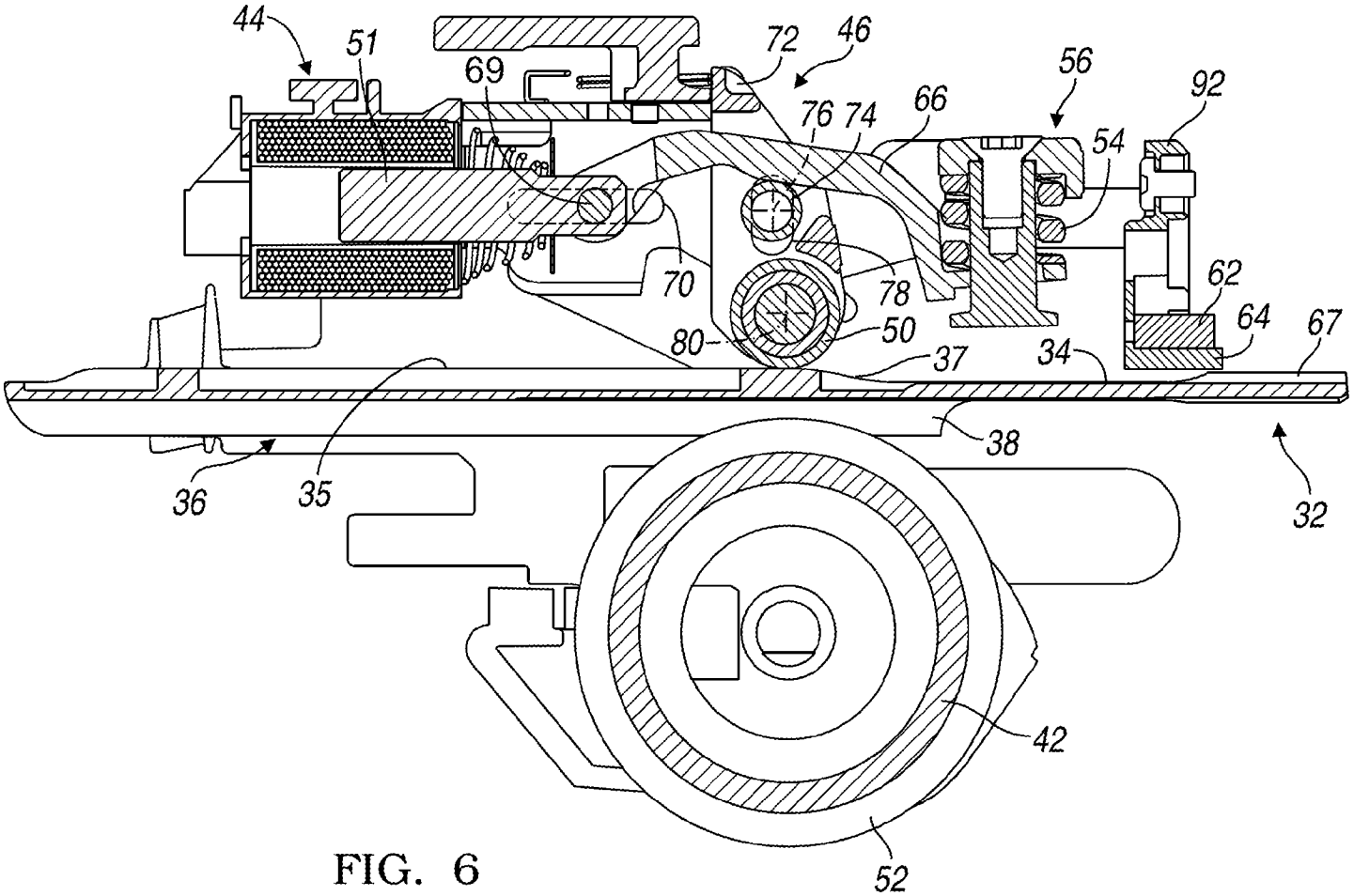
FIG. 6 is a cross-sectional view similar to FIG. 5, illustrating the components of FIG. 2 in engaged or driving positions.

In FIG. 6, the driver 32 is being fired toward its extended axial position (further to the right in the figure) and the driver 32 is in its radial firing position. Consistent with this, each of the plunger 51 of the actuator 44, and the follower assembly 46, including the follower 50, are in their respective engagement positions. In particular, the engagement position of the follower assembly 46, including follower 50, pushes the driver 32 into a driving position where the driver 32 is in driving engagement against the flywheel 42. The driver 32 includes a profile portion 36 and a blade portion 34. On the flywheel 42 side of the profile portion 36 of the driver 32, the driver 32 can include a shaped driver profile 38 for engaging grooves 52 of the flywheel 42. On the follower 50 side of the profile portion 36 of the driver 32, the driver 32 can include a cam profile including a raised cam profile 35 and a transition cam profile 37 against which the follower 50 engages. As the follower 50 rides up the transition cam profile 37, the pinching force acting on the driver 32 between the follower 50 and the flywheel 42 increases as the spring member 54 of the biasing mechanism 56 is compressed.

The distal end of the blade portion 34 of the driver 32 can contact against the head of a fastener and drive the fastener as the driver 32 moves to its axially extended position, where a bumper surface 57 of the extensions 58 of the driver 32 can contact against the bumpers 60. The driver 32 can be made from a ferromagnetic material. The driver 32 can be investment cast as a single part from steel, including both the driver profile portion 36 and the driver blade 34 portion.

Figure 3:
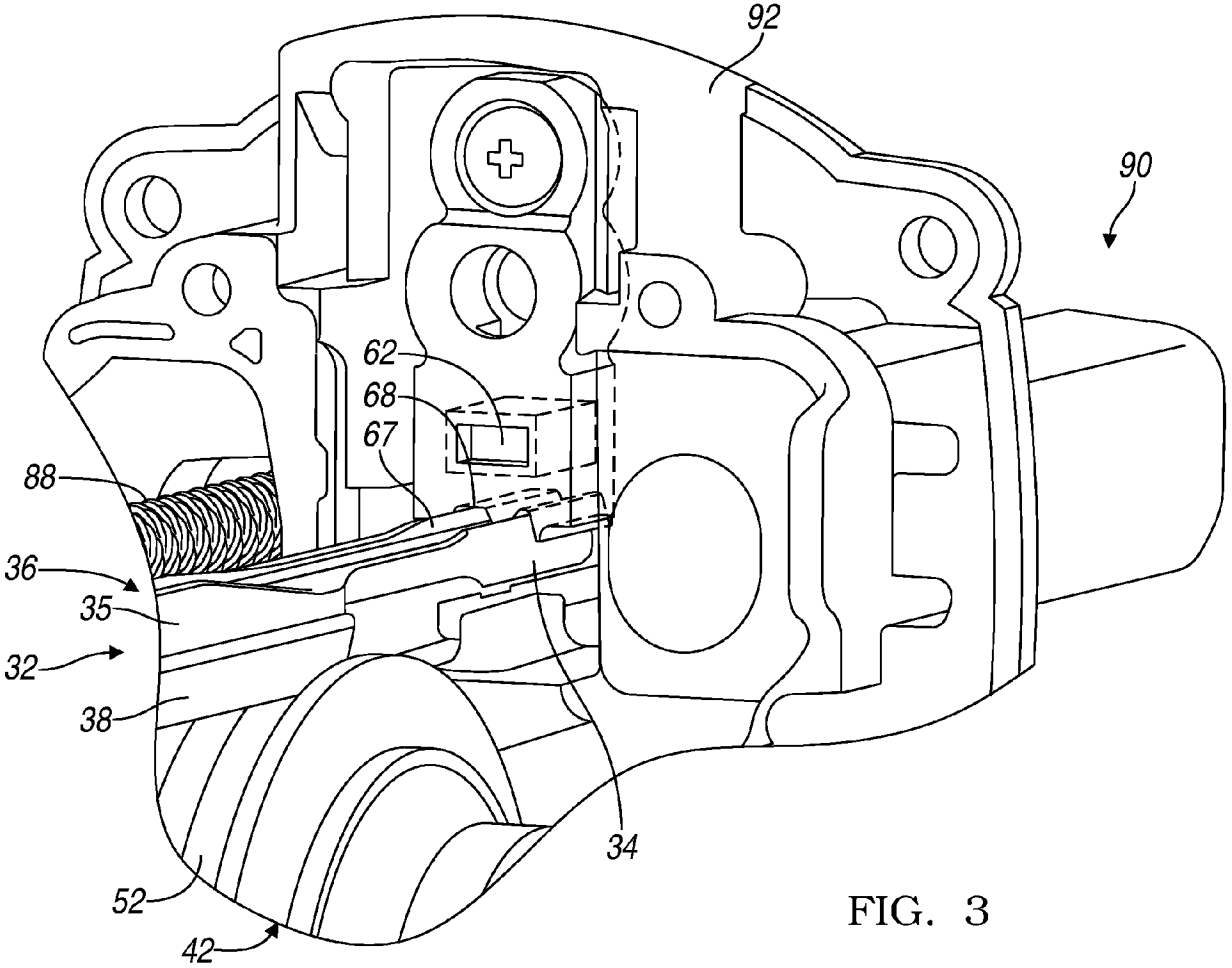
FIG. 3 is a partial perspective view including some of the components of FIG. 2.
Figure 3A:
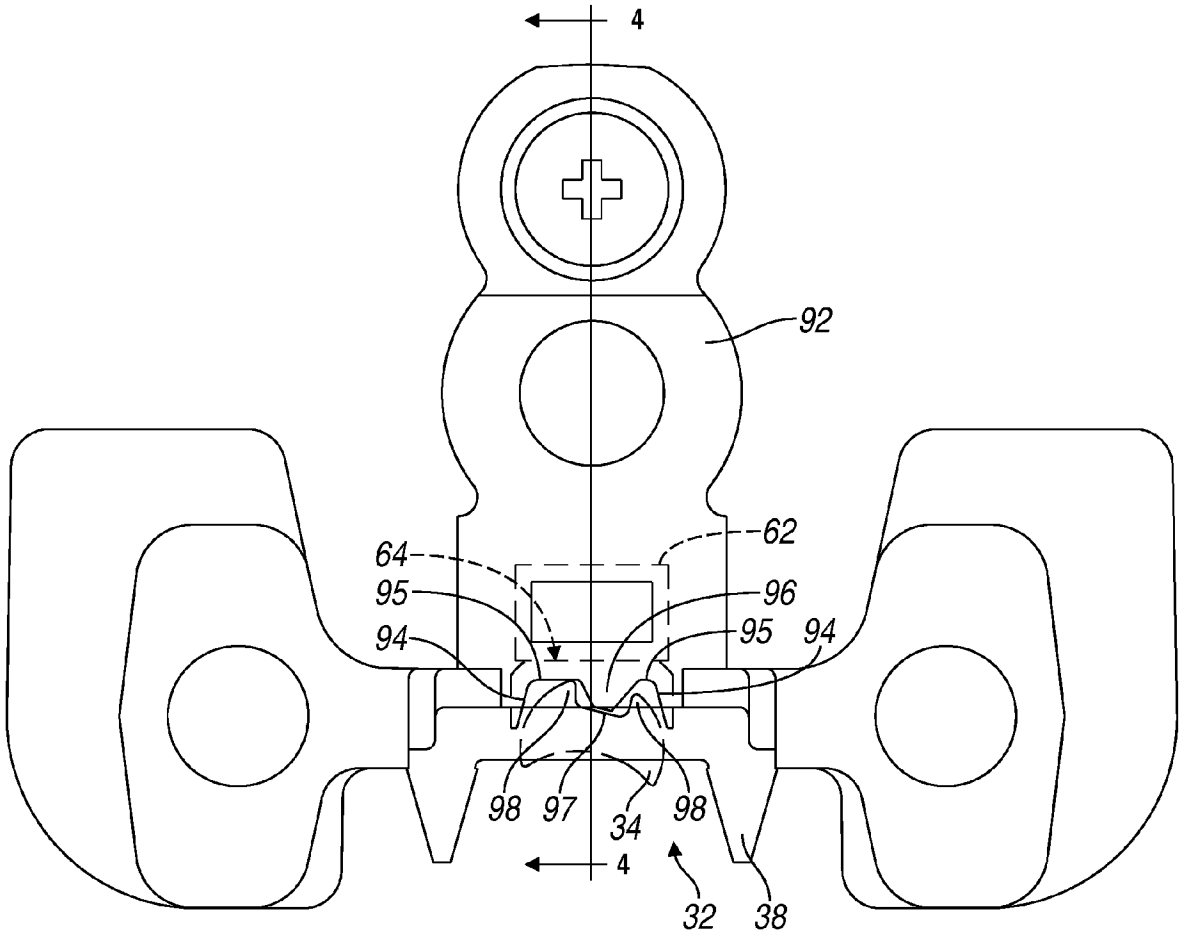
FIG. 3A is an enlarged partial view of the inter-engagement between the intermediate wall and the driver.
Figure 4:
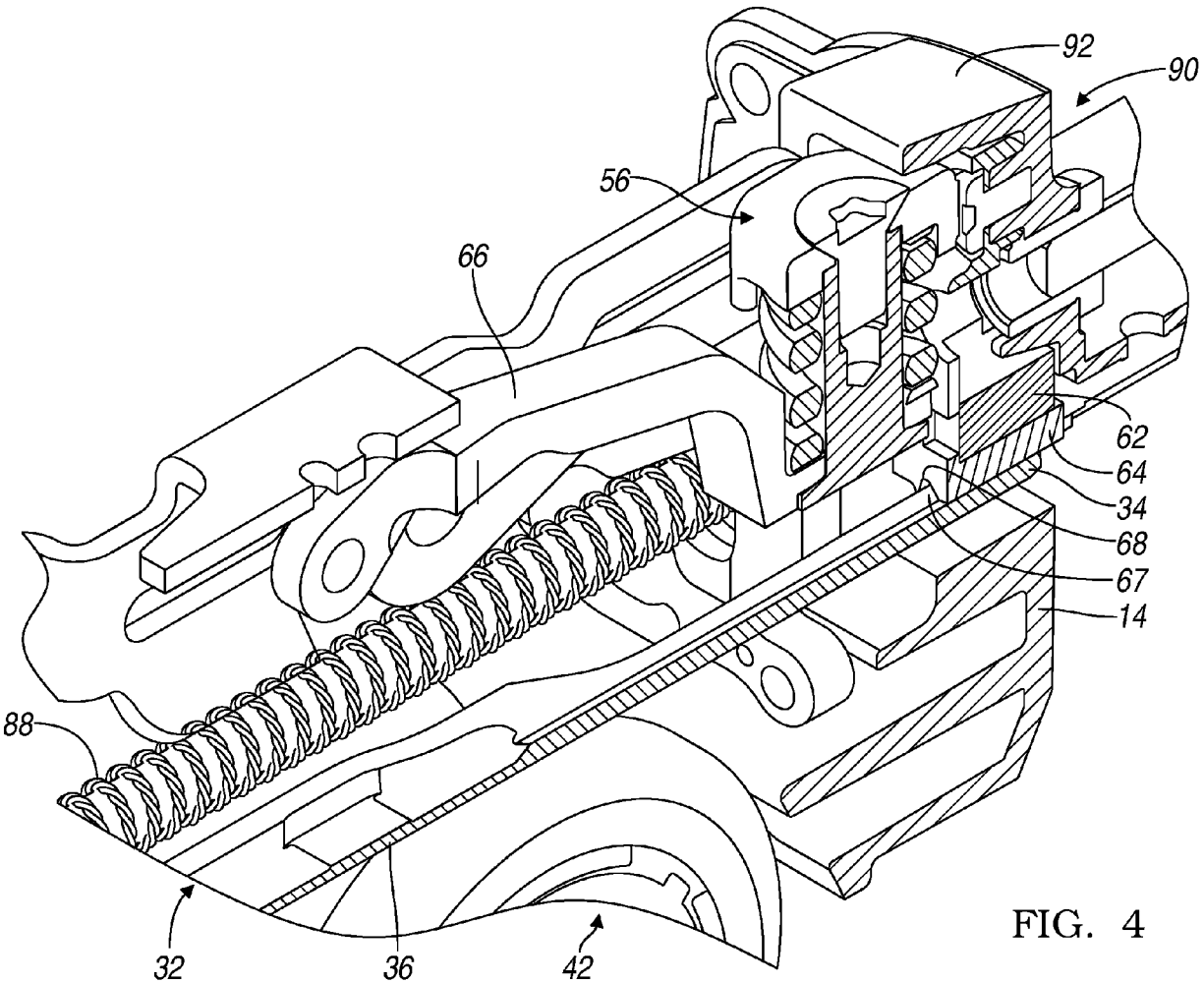
FIG. 4 is a partial cross-sectional view along line 4-4 of FIG. 3A including some of the components of FIG. 2.

In FIGs. 3-5, the driver 32 is in its returned axial position and in its radial home position. Consistent with this, each of the plunger 51 of the actuator 44, and the follower assembly 46, including the follower 50, are in their respective home positions. Similar to the home position of the driver 32, the home position of the follower 50 can be radially further spaced from the flywheel 42 than in its engagement or firing position (at least prior to moving up the transition cam profile 37). It should be appreciated, that although the driver 32 can have a slightly angled orientation in its home position (FIG. 5) relative to its driving orientation (FIG. 6), but this need not be the case.

Briefly, follower assembly 46 can include an arm 66 coupled at one end to the plunger 51 of the actuator 44 via a pin 69 extending through a guide slot 70. The arm 66 can be coupled at its opposite end to the biasing mechanism 56, including the spring 54. Arm 66 can engage against a carrier 72 via a roller 74 mounted on an axle or pivot 76 engaged within a guide slot 78. The follower 50 can be coupled to the carrier 72 via an axle 80. Additional details of the follower assembly 46 and its operation are disclosed in commonly owned U.S. patent application Ser. No. 13/797,046, filed Mar. 12, 2013, which is hereby incorporated herein by reference in its entirety.

As noted above, the home position of the driver 32 is radially further away from the flywheel 42 than its firing position. A magnet 62 is provided to pull the driver 32 toward the home position. In the home position of the driver 32, the driver blade 34 can be engaged against an intermediate wall 64 coupled to the frame 14 and positioned between the magnet 62 and the driver 32. The magnetic force of the magnet 62 can have sufficient flux strength to prevent the driver 32 from moving side-to-side (perpendicular to the driver axis or driving path) when the driver 32 is in the home position.

The intermediate wall 64 can be a part of a nose assembly 90 adjacent the distal driving end of the driver 32. Nose assembly 90 can include a nose member 92 coupled to the frame 14. Intermediate wall 64 can be formed as a single integral part with the nose member 92. For example, the nose member 92, including the intermediate wall 64 can be formed as a single piece plastic part. Alternatively, intermediate wall 64 can be a separate component that is coupled to the nose member 92, or some other component of the nose assembly 90. For example, the intermediate wall 64 can be an investment cast steel part coupled to the nose assembly 90. It should be appreciated that, although the magnet 62 is positioned within the nose assembly 90 of the tool 10 and adjacent the distal driving end of the driver 32, alternative positioning and coupling of the magnet 62 may be possible.

The driver 32 can have a cross-sectional shape defining a mating surface 67 for engaging against the intermediate wall 64 when the driver 32 is in its home position. The intermediate wall 64 can have a cooperating cross-sectional shape to define a cooperating mating surface 68. The cross-sectional shapes of the mating surfaces 67, 68 can be configured to restrain side-to-side movement of the driver 32 when the mating surfaces 67, 68 are contacting each other with the driver 32 in its home position. In this example, the mating surface 68 of the intermediate wall 64 includes a recess defined by two downwardly outwardly extending outer walls 94 configured to help center the driver blade 34 therebetween. The upper wall 95 of the recess includes a generally centrally located protruding portion 96 configured to engage into a cooperating recess 97 of the driver blade 34 with side portions 98 operating as protrusions. As such each of the mating surfaces 67, 68 includes at least one protruding portion extending into and at least one cooperating recessed portion. The mating surfaces can include at least one generally convex shaped portion and at least one cooperating generally concave shaped portion.

Not only do these inter-engaging mating surfaces 67, 68 operate to prevent or reduce side-to-side movement of the driver 32, but the inter-engaging surfaces 67, 68 can operate to center the driver 32 in alignment with the driver axis. Each of these can eliminate or reduce the possibility of the driver 32 and the flywheel 42 contacting each other while the flywheel 42 is spinning up to speed for firing.

As noted above, the magnetic force or flux of the magnet 62 is sufficiently strong to pull the driver 32 into its home position from its engagement position against the flywheel 42. The magnetic force acting on the driver 32 can be limited by the downward force the actuator 44 and follower assembly 46 can exert on the driver 32 in moving from their home position to their respective engagement or driving positions. Thus, it should be appreciated that the magnetic flux of the magnet 62 may be strong enough to prevent or reduce side-to-side movement of the driver 32 when used in combination with the inter-engaging mating surfaces 67, 68.

In operation, a user typically engages both a contact trip switch 82 and a trigger switch 84 that are coupled to a control unit 86, which is coupled to the actuator 44 and to the motor 40. The control unit 86 can be configured to fire only when both switches 82, 84 are engaged. The control unit 86 can be configured to require a particular order or sequence of engagement of the switches 82, 84, or not. Typically, when the first of the switches 82, 84 is engaged in a firing sequence, the control unit 86 will activate the motor 40 causing the flywheel 42 to spin up to speed. It is during this period of time (before the second switch in the firing sequence is engaged) that the magnet 62 can be particularly beneficial in preventing side-to side movement of the driver 32; either alone, or in combination with the inter-engaging mating surfaces 67 and 68.

Upon engagement of both switches 82, 84 in a firing sequence, the control unit 86 activates the actuator 44, moving the follower assembly 46 toward its engagement or driving position, during which the driver 32 is pushed out of its radial home position and away from the magnet 62 and the intermediate wall 64, and pinched between the follower 50 and the flywheel 42 in its engagement or driving position. Thus, the driver 32 engages the flywheel 42 and is fired forward along the driver axis toward the extended axial position of the driver 32, in which the bumper surfaces 57 of the extensions 58 engage respective bumpers 60. A return mechanism that can include a pair of compression return springs 88 then returns the driver 32 to its axial returned position, in which magnet 62 again pulls the driver 32 back into its radial home position against the intermediate wall 64. No matter how many times this process is repeated, the magnet 62 does not suffer any mechanical wear.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure. Furthermore, the mixing and matching of features, elements and/or functions between various examples is expressly contemplated herein, even if not specifically shown or described, so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description.

What is claimed is:

1. A flywheel-driven fastener driving tool comprising:

a frame;

a motor coupled to the frame and operably coupled to a flywheel to rotate the flywheel around a revolution axis fixed in relationship to the frame;

a driver comprising a ferromagnetic material movable along a driver axis relative to the frame between a returned position and an extended position, and the driver having a firing position in which the driver is drivingly engaged against the flywheel, and having a home position further away from the revolution axis of the flywheel than the firing position when the driver is in the returned position and the flywheel is spinning in preparation to firing the driver toward the extended position;

a magnet coupled to the frame and positioned adjacent the driver to exert a magnetic force on the driver to pull the driver into the home position.

2. The flywheel-driven fastener driving tool of claim 1, wherein the magnetic force prevents the driver from moving side-to-side when the driver is in the home position.

3. The flywheel-driven fastener driving tool of claim 1, wherein the driver is a single part investment casting.

4. The flywheel-driven fastener driving tool of claim 1, wherein the magnet is positioned on one side of an intermediate wall coupled to the frame and the driver is positioned on an opposite side of the intermediate wall from the magnet, and wherein the driver contacts against the opposite side of the intermediate wall when in the home position.

5. The flywheel-driven fastener driving tool of claim 4, wherein the driver has a cross-sectional shape defining a mating surface contacting against the intermediate wall when the driver is in the home position, and the intermediate wall has a cooperating cross-sectional shape defining a cooperating mating surface, and wherein the cross-sectional shapes are configured to restrain side-to-side movement of the driver when the driver is in the home position.

6. The flywheel-driven fastener driving tool of claim 5, wherein the mating surface of the driver and the cooperating mating surface of the intermediate wall comprise at least one protrusion extending into at least one recess.

7. The flywheel-driven fastener driving tool of claim 1, wherein the driver comprises a profile portion and a blade portion, and the magnet is positioned adjacent the blade portion of the driver when the driver is in the returned position.

8. The flywheel-driven fastener driving tool of claim 7, wherein the driver is a single part investment casting.

9. A flywheel-driven fastener driving tool comprising:

a frame;

a motor coupled to the frame and operably coupled to a flywheel to rotate the flywheel;

a driver comprising a ferromagnetic material movable along a driver axis relative to the frame between a returned position and an extended position, and the driver having a firing position in which the driver is engaged against the flywheel, and having a driver home position further away from a revolution axis of the flywheel than the firing position when the driver is in the returned position and the flywheel is spinning in preparation to firing the driver toward the extended position;

a follower coupled to the frame and having a follower engagement position corresponding to the firing position of the driver in which the driver is pinched between the follower and the flywheel, and the follower having a follower home position allowing the driver to move into the driver home position;

a magnet coupled to the frame and positioned adjacent the driver to exert a magnetic force on the driver to pull the driver into the driver home position;

wherein the magnet is positioned on one side of an intermediate wall coupled to the frame and the driver is positioned on an opposite side of the intermediate wall from the magnet, and wherein the driver contacts against the opposite side of the intermediate wall when in the driver home position.

10. The flywheel-driven fastener driving tool of claim 9, wherein the magnetic force prevents the driver from moving side-to-side when the driver is in the driver home position.

11. The flywheel-driven fastener driving tool of claim 9, wherein the driver is a single part investment casting.

12. The flywheel-driven fastener driving tool of claim 9, wherein the driver has a cross-sectional shape defining a mating surface contacting against the intermediate wall when the driver is in the driver home position, and the intermediate wall has a cooperating cross-sectional shape defining a cooperating mating surface, and wherein the cross-sectional shapes are configured to restrain side-to-side movement of the driver when the driver is in the driver home position.

13. The flywheel-driven fastener driving tool of claim 12, wherein the mating surface of the driver and the cooperating mating surface of the intermediate wall comprise at least one protrusion extending into at least one recess.

14. The flywheel-driven fastener driving tool of claim 9, wherein the driver comprises a profile portion and a blade portion, and the magnet is positioned adjacent the blade portion of the driver when the driver is in the returned position.

15. The flywheel-driven fastener driving tool of claim 14, wherein the driver is a single part investment casting.

16. A method of operating a fastener driver tool comprising:

providing a fastener driver tool that includes a frame and an electric motor coupled to the frame, a flywheel driven by the electric motor, a ferromagnetic driver magnetically held in a home position adjacent the flywheel while the flywheel is spinning in preparation to fire, an actuator to push the ferromagnetic driver toward a revolution axis of the flywheel into driving engagement with the flywheel to fire the ferromagnetic driver; and a magnet exerting a magnetic force to pull the ferromagnetic driver radially away from the flywheel and into the home position after the ferromagnetic driver has been fired;

wherein the magnetic force of the magnet prevents the ferromagnetic driver from moving side-to-side when the ferromagnetic driver is in the home position.

17. The method of operating a fastener driver tool of claim 16, wherein the ferromagnetic driver is provided with a blade portion and a profile portion investment cast as a single part.

18. The method of operating a fastener driver tool of claim 16, wherein providing the magnet comprises positioning the magnet on one side of an intermediate wall coupled to the frame, and providing the ferromagnetic driver comprises positioning the ferromagnetic driver on an opposite side of the intermediate wall from the magnet to contact against the opposite side of the intermediate wall when in the home position.

* * * * *